United States Patent [19]

Norwood

[11] 4,150,721

[45] Apr. 24, 1979

[54] GAS WELL CONTROLLER SYSTEM

[76] Inventor: William L. Norwood, 232 Crestview Rd., Columbus, Ohio 43202

[21] Appl. No.: 868,674

[22] Filed: Jan. 11, 1978

[51] Int. Cl.[2] ..... E21B 43/00; E21B 43/12

[52] U.S. Cl. ..... 166/53; 166/65 R; 166/66; 166/64; 166/314; 137/625.64

[58] Field of Search ..... 166/53, 65 R, 314, 66, 166/64; 251/137, 140; 137/625.64

[56] References Cited

U.S. PATENT DOCUMENTS

| | | | |
|---|---|---|---|
| 1,754,946 | 4/1930 | Haskell | 166/53 |
| 3,114,394 | 12/1963 | Panissidi | 137/625.64 |
| 3,126,031 | 3/1964 | Hayner | 137/625.64 X |
| 3,266,574 | 8/1966 | Gandy | 166/53 |
| 3,396,793 | 8/1968 | Piper et al. | 166/53 |
| 3,678,997 | 7/1972 | Barchard | 166/53 |
| 3,863,714 | 2/1975 | Watson, Jr. | 166/53 |

*Primary Examiner*—Stephen J. Novosad
*Attorney, Agent, or Firm*—Sidney W. Millard; Gerald L. Smith

[57] ABSTRACT

A controller system for a flowing gas well utilizing battery powered solid state production and cycle time-out circuitry. In addition to expanded cycle interval capabilities, the system permits a broad range of automated controls over well production through the continuous monitoring of and reaction to such parameters as casing pressure, tubing string pressure, plunger elevation, sales line pressure and flow rate, as well as liquid level monitoring within separation and storage facilities. The solid state circuitry incorporates such features as liquid crystal readout, battery voltage level monitoring and automatic reset at the commencement of each timing cycle. Motor valve actuation is provided by electromagnetic actuation of a controller mounted shuttle piston valve.

17 Claims, 11 Drawing Figures

FIG. 6
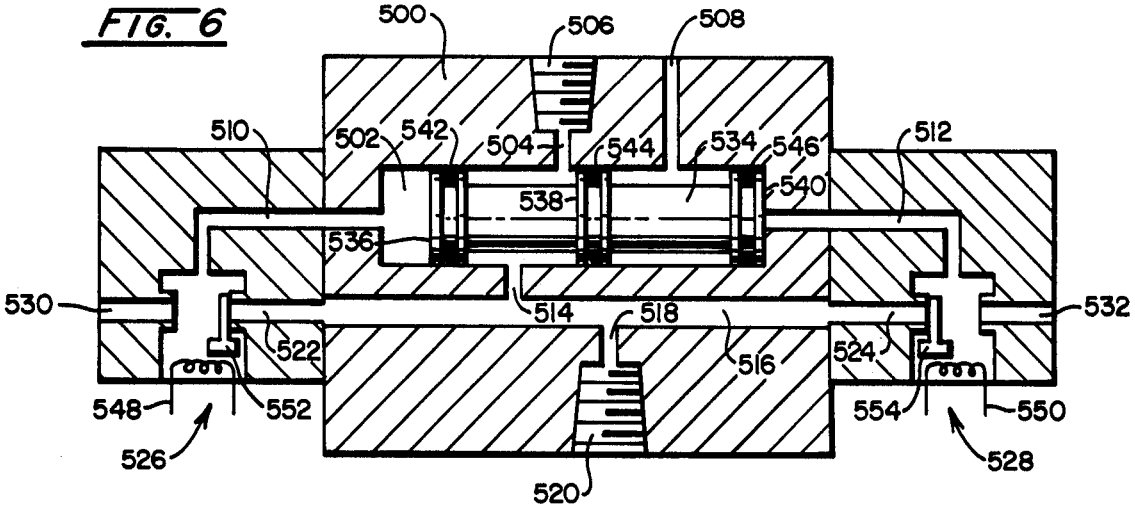
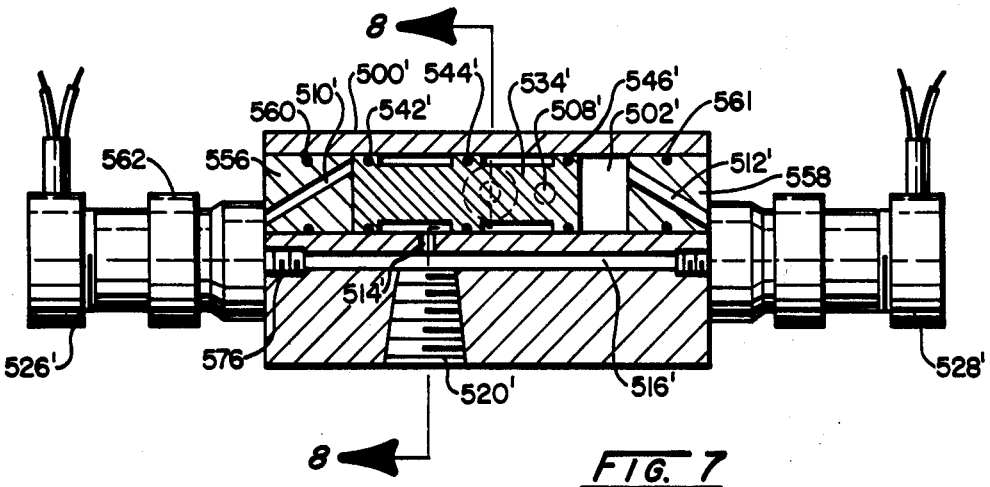
FIG. 7
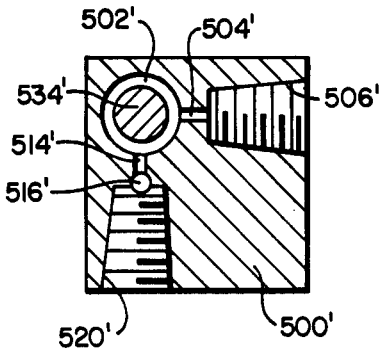
FIG. 8
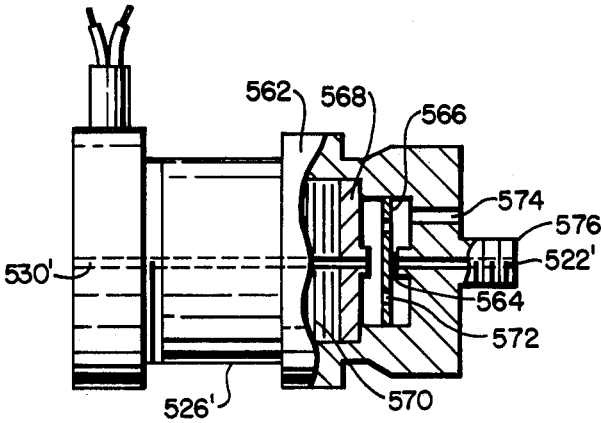
FIG. 9

GAS WELL CONTROLLER SYSTEM

BACKGROUND

Techniques for the operation of gas wells producing from petroleum reservoirs vary substantially not only from geologic region to region but also among wells producing from a given reservoir. Commonly, flowing gas wells are adversely affected by accumulations within the well casing and tubing of liquids usually comprised of oil and salt water. As such fluids accumulate, the gas flow production of a well may diminish to the point of failure in consequence of the static pressure buildup within the tubing and/or casing. To achieve an optimization of the production from the well, therefore, the well operator is called upon to monitor pressure related parameters of this performance. Generally, any given well will exhibit its own unique performance "signature" which may itself vary with time.

A conventional approach for correcting for liquid build-up in a gas well involves a procedure referred to as "intermitting"; a cyclically performed operation wherein accumulated liquid is forced out of the well under gas pressure. In a typical intermitting procedure, mechanical clock-type controllers are provided which operate on a regular time cycle over repeating twenty-four hour intervals to periodically vent the well to the atmosphere and effect forcible expulsion of the liquid within the tubing string. Venting to the atmosphere now is considered disadvantageous both from an environmental standpoint as well as in consequence of the waste of valuable natural gas. As a consequence, other techniques now are generally employed. Another intermitting technique which has been utilized provides for the pressure monitoring of the tube string and casing of a given well. The system is based upon the observation that the appropriate time to clear a well can be determined by noting the differential in pressure between tubing and casing. This differential, in general, will represent the height of the fluid in the tubing above the bottom of the well. When the well monitors indicate that a predetermined differential in pressure is present, a motor valve is automatically opened to provide for fluid expulsion. See for example, U.S. Pat. No. 3,266,574. In another arrangement, for example as described in U.S. Pat. No. 3,863,714, a control is provided wherein the well is vented periodically in correspondence with the pressure within the tubing string. The output of the tubing string of the well is controlled by a motor valve, which in turn, is operated by pressure pilot valves responsive to the rate of flow and the differential existing between the sales and tubing lines to determine the producing interval.

In some geologic regions, for example in the Appalachian region, as well as regions in the Fort Worth basin, flowing gas wells are very difficult to produce. As a consequence, other techniques of production are required. For example, most such wells cannot merely be "intermitted," but must be produced on a cyclical basis. This technique involves a "shutting-in" procedure wherein the well is closed for a carefully determined interval of time sufficient to allow well pressure to build up sufficiently to expel all fluids upon subsequent opening up. Production only occurs during that relatively short interval wherein fluid and gas are expelled into the sales line system. The well then again is shut-in to achieve necessary pressure build-up. As is apparent, the timing of these operations is critical. For example, a typical well may produce for a twenty minute interval following which it must be shut-in for an interval of four hours. Because the duty cycle of the well is so short, deriving an optimum formula for producing it becomes a taxing endeavor. Many production parameters are considered, no two wells exhibiting the same performance signature. Particular note may be made of the economics associated with only minor changes in the production interval. For instance, a four minute deletion from a twenty minute production interval represents a 20% loss in sales revenue. Further, failure to shut-in such a well within mere minutes of the proper time envelope of production well may result in a complete loading up of the well. This represents a failure which may be very expensive to correct. One technique for correcting for "loading up" is to shut-in the well for an extended interval of time, e.g. 48 hours.

The tubing string in wells within the noted region generally incorporates a plunger lift device. With this arrangement, when the well is shut in, the plunger is situate in the lowermost portion of the tubing string. As gas pressure develops within the well during the shut-in interval, fluid accumulates in the tubing string above the plunger. At an optimum point in time, a motor valve coupled between the tubing string and separation and collection equipment is opened to permit the plunger to be propelled to the surface and fluid and gas which has collected above the plunger within the string is delivered into the sales system. Through the use of separation stages and the like, the liquid is segregated from the gas and the gas cap, for the production interval, is recovered. For the most part, control over these wells has been one based simply upon a somewhat crude clock-operated device, the cyclical closing and opening of a motor valve being determined by the operator following the periodic monitoring of a variety of parameters such as the differential pressure between casing and tubing string, sales line pressure, experience with adjacent wells, etc. With such monitoring, the signature of the well, i.e. the periodic development of pressure differentials optimum for producing and shutting in are determined and the clock controls are adjusted accordingly. Such periodic operation of the wells is found to be inadequate in many cases and the failure to accommodate for the various conditions which can exist for a given well may lead to a loading-up wherein expensive swabbing procedures and the like are required to clear the tubing. While the periodic shutting-in and opening of a well to produce it is desirable, the controllers available in the art exhibit many deficiencies by virtue of their incapability of responding to a broad variety of operational parameters. For example, it will be highly desirable to develop an easily adjusted on-off cycle accurate to within a minute which extends well beyond twenty-four hour intervals. Where conventional controllers are adjusted, for example, to operate at a 48 to 72 hour cycle, the incremental timing interval must be expanded accordingly to 4 or 6 minutes. The latter trade-off generally is considered unacceptable. Further, conditions often will be encountered where the cyclical timing system must be overridden and subsequently reinitiated on an automatic basis. For example, should the tubing pressure at the well head fall to a certain predetermined level an indication may be present that gas is not finding its way up through the tubing string and that liquid is building up. Accordingly, such a situation may represent an overriding condition calling for shutting in the well. Other conditions may relate to the safe operation of a gas production system. For example excessive liquid levels in separating systems will call upon an overriding of well cycling. Line pressure fluctuations may have a particularly deleterious effect upon the production of a well and production controls should be capable of monitoring for such conditions and reacting accordingly. In effect, a broad variety of conditions can be contemplated for monitoring and reaction to achieve the optimization as well as automation of flowing gas well production.

SUMMARY

The present invention is addressed to an improved flowing gas well control system and apparatus in which the well operator is given a wide latitude of control in seeking the optimization of well production. Utilizing a controller incorporating solid state digital electronics greatly expanded production and shut-in cycle intervals are available with highly accurate time-out techniques. A liquid crystal read out mounted within the housing of the controller of the system serves to apprise the operator of ongoing cycle timing conditions as well as to provide information as to energization states and motor valve status.

The flexibility afforded the operator with the apparatus of the invention, for example, permits the well to be shut-in for an extended interval, e.g. 48 hours to correct for a loading up, following which the system may be produced for short, accurately controlled production intervals, e.g. 20 minutes and subsequent lengthier shut-in periods, e.g. 4 hours. Such a program may be inserted by the operator with only one simple adjustment.

Through the utilization of CMOS circuitry, the controller may be powered over extended periods of time by inexpensive, locally available batteries such as D-cells. To assure properly powered performance, the control cicruit of the controller incorporates a low voltage level warning system having an output at the liquid crystal display which flashes at a predetermined frequency for enhancing visual perception.

In operating the system of the invention, the operator inserts desired cycle times which may range to about 100 hours for each off or each on cycle through the adjustment of binary coded decimal switches mounted with the control housing. Such adjustment is made for each of the on and off cycles desired. The controller also incorporates two manually actuated switches which serve either to commence a shut-in cycle time-out function or a production cycle time-out function. The circuit serves advantageously to buffer the output signal generated through actuation of these switches and these switches may be utilized to override an ongoing cycle function at the option of the operator. With the actuation of any of these switches, the control circuit of the system serves to reset the frequency generating function thereof so as to provide appropriate accuracy.

As another feature and object, the invention provides a flowing gas well control system affording the operator broad flexibility in monitoring a significant number of parameters within a gas well facility. This is accomplished through the use of normally open switches associated with sensing devices. The switches are coupled to the controller of the system through a common terminal connected preferably with the off-state switch function of the controller. In one arrangement, a magnetically actuated proximity switch is utilized to sense the position of a plunger as it reaches the well head bumper. The switch may be utilized to commence off-cycle timing. In another arrangement, a gas pressure actuated normally open switch is utilized in conjunction with the pressure levels developed within the tubing string itself to carry out the commencement of an off or shut-in cycle timing phase. In still another arrangement, a pressure operated normally open switch is utilized in conjunction with sales line pressure. Once such pressure reaches a prohibitive level, the switch is actuated to, in turn, cause the well to shut-in for a predetermined off-cycle interval. Similarly, a normally open pressure actuated switch may monitor casing pressure at the well head such that when the pressure within the casing reaches a predetermined level an off or shut-in cycle automatically is commenced.

Another feature and object of the invention resides in the provision of monitoring devices within the separator and storage tanks of an installation. In this regard, a liquid level responsive gauge may be positioned within the separator itself as well as within a storage tank to provide automatic off-cycle switch actuation and consequent shut-in cycling. In the same regard, the flow rate of gas within the sales line may be monitored and, should such rate fall below a predetermined level, a normally open switch is closed to carry out motor valve actuation to derive a shut-in state.

Another object and feature of the invention resides in a unique shuttle valve incorporated within the controller housing itself. This valve is actuated from the control circuitry of the device through the utilization of two tractive electromagnetic devices.

Other objects of the invention will, in part, be obvious and will, in part, appear hereinafter.

The invention, accordingly, comprises the system and apparatus possessing any construction, combination of elements and arrangement of parts which are exemplified in the following detailed disclosure.

For a fuller understanding of the nature and the objects of the invention, reference should be had to the following detailed description taken in connection with the accompanying drawings.

BRIEF DESCRIPTION OF THE DRAWINGS

FIG. 6 is a sectional schematic view of a valve used in connection with the controller of the invention;

FIG. 7 is a partially sectional and elevational view of a valve utilized in conjunction with the controller of the invention;

FIG. 8 is a sectional view of the valve of FIG. 7 taken through the plane 8—8 thereof; and FIG. 9 is an elevational view of an electromagnetically driven valve used in conjunction with the valve of FIG. 7, with portions broken away to reveal internal structure.

DETAILED DESCRIPTION

Figure 1:
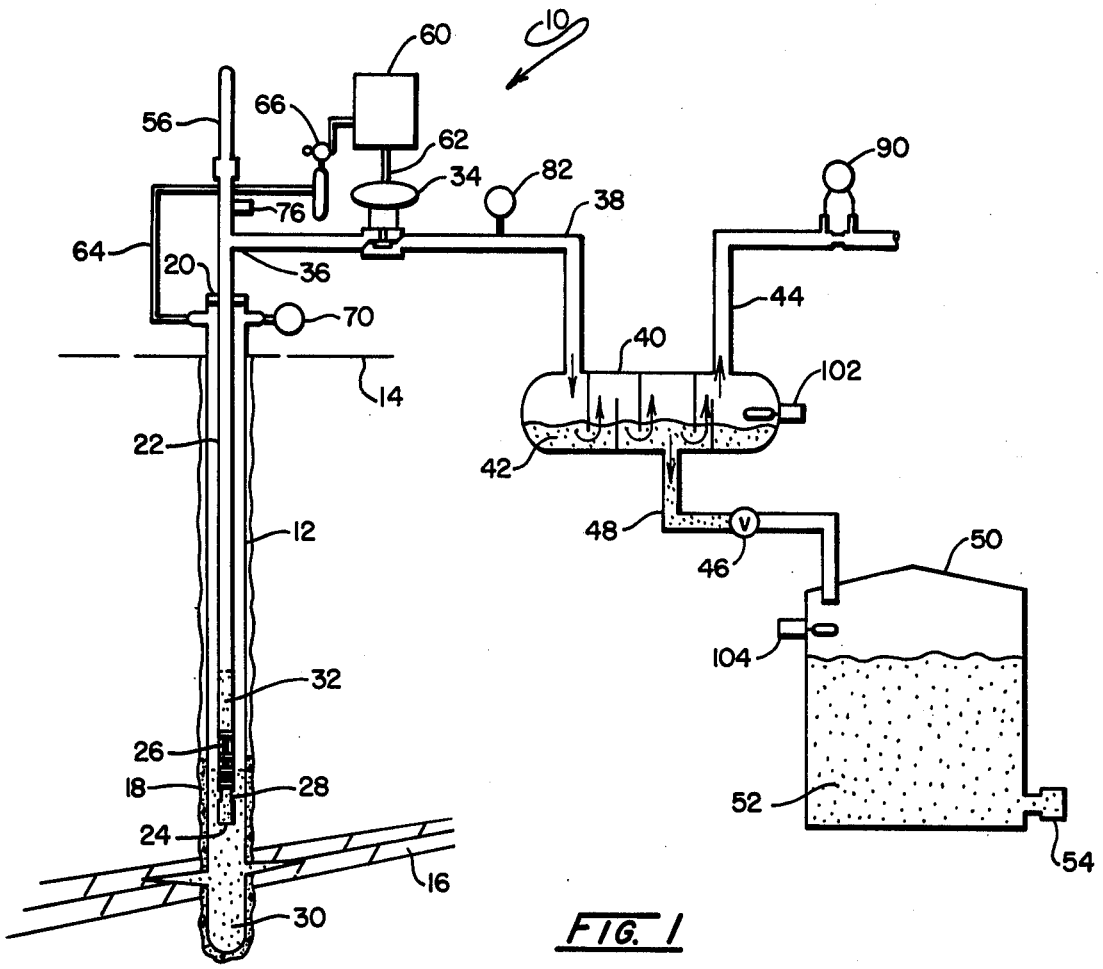
FIG. 1 is a sectional schematic view of a flowing gas well installation with components shown sectionally and out of scale.

The operational production of a flowing gas well essentially is an heuristic procedure involving the variable performance parameters of tubing string pressures, well head pressures, sales line pressures, location of operational components within the tubing string, liquid levels within separators and storage as well as gas flow rate indications. Inasmuch as these parameters may vary widely from one well installation to another, the optimization of the production of any given well installation has been found in the past to be most elusive. To gain some incite into the production requirements for a well installation, a typical flowing gas well is schematically portrayed in FIG. 1. Referring to that figure, a well installation as might be found, for example, in the midwestern region of the United States is revealed generally at 10. Installation 10 includes an elongate casing 12 which extends through the terrestrial surface 14 to a strata 16. Generally, strata 16 is present as porous rock over which an impervious cap is located. The resultant formation serves as a form of pressurized reservoir for oil, gas, water and the like. While the techniques for penetrating strata 16 with casing 12 varies from installation to installation, generally, the outer surface of the casing is sealed with conventional cementing procedures, this seal being represented at 18. Access to the strata or formation 16 following the placement of seal 18 may be provided utilizing a variety of techniques, for instance, controlled explosions. Surface control over the well is maintained by a well head 20 extending above surface 14. Head 20 incorporates appropriate hangers and seals which serve to support a tubing string 22 which extends, for example, from the vicinity of well head 20 to an open lower end 24 situate in the vicinity of the lower level of casing 12. In some installations, a plurality of tubing strings 22 are utilized, each extending to a predetermined geologic formation to evolve production at that location. The figure further reveals the presence of a plunger or "rabbit" 26 near opening 24. The device is prevented from moving through the opening 24 by a constriction 28. With the plunger lift arrangement, well installation 10 is operated on a cyclical basis, being shut-in for an interval during which gas pressure gradually elevates within casing 12. Additionally, a liquid generally comprising oil and salt water, as at 30, accumulates within casing 12 which gradually migrates through tubing string 22 above plunger 26, as represented at 32. Plungers as at 26 are available to the industry from a variety of sources, for example Axelson, Inc., Longview, Texas.

At a point in time ideal with respect to the pressure of gas within casing 12 and the level of accumulated liquid 32, a motor valve, shown schematically at 34, is opened which causes plunger 26 to be propelled from the lower end of the tubing string 22 under the influence of the accumulated gas pressure. As this occurs, the liquid and gas above plunger 26 moves through a horizontal, T connection 36 and the open motor valve 34 to be directed into conduit 38, representing the initial component of a sales line to a separator 40. Separators as at 40 are provided in the variety of configurations, that illustrated being schematically representative of a single tube horizontal device. The gas and liquid mixture enters separator 40 from tube 38 whereupon its velocity and directional flow are altered to permit fall-out of heavier liquids to the bottom of the tank, as represented at 42. Gas and spray are collected in the upward portions of the separator 40 wherein smaller droplets coalesce to larger ones to join the fluid at 42 and, following final liquid particulate removal, as through mist extractors or the like, gas enters outlet conduit 44 of the sales line. By appropriate manipulation of valving as at 46, the collected liquids 42 are drawn from separation stage 40 through a conduit as at 48 to be introduced to an oil and water storage facility, represented by tank 50. Here the oil and water is retained at variable levels, as represented at 52, a natural form of separation taking place prior to its removal as by trucking or the like by communication through valve 54.

Returning to the well structure, as the plunger 26 is propelled under gas pressure, it passes T-connection 36 whereupon it encounters a bumper structure and/or lubricator 56. The plunger 26 remains at this upward location against the bumper structure until gas flow rate diminishes to an extent permitting it to fall under gravity to its initial position against, for example, construction 28. To permit optimized production for the well installation 10, motor valve 34 is closed to shut-in the well for an interval of time prior to the commencement of a next plunger lift and removal of the gas cap. As indicated hereinabove, the production and shut-in cycles providing optimum production varies from well to well. As a consequence, the well technician is called upon to examine various parameters of its initial performance to derive a form of signature representing the best cycling of the well through the opening and closing of motor valve 34. Usually, this initial evaluation is carried out by observing the differential pressure between tubing string 22 and casing 12. This difference, in general, represents the height of fluid 32 above plunger 26. When the timing of such pressure responses is determined for optimum production, a controller, in the past being provided as a mechanical clock operated device, is present to provide sequentially occuring off and on or shut-in and producing states of performance for the installation 10.

A controller for carrying out the timing of the cyclical operation is represented generally in the figure at 60. Controller 60, at appropriate cyclical intervals, applies or releases lower pressure drive gas, i.e. at a pressure of about 25 p.s.i.g., through a conduit 62 to the diaphragm drive of motor valve 34. The supply of this lower pressure gas is derived from the well head as through conduit 64 which leads to a filter and regulator 66 and thence to the input of a control valve positioned within controller 60.

As is apparent, it is desirable that the cycling interval capability of controller 60 be as broad as possible to permit efficient production. Where the cycling time availability is limited, for example to the twenty-four hour capability of current devices, the well cannot be produced at highest efficiency and gradually may recycle out of an optimized program. As this occurs, the well may be "loaded up" to an extent wherein the fluid 32 is of such a height prior to opening valve 34 as to render the movement of plunger 26 impossible. With the present invention, greatly expanded periods for each cycle are available to the operator. The controller additionally enjoys the capability of monitoring a plurality of other production parameters to provide an override over the otherwise dominant cyclical control of motor valve 34.

Figure 4:
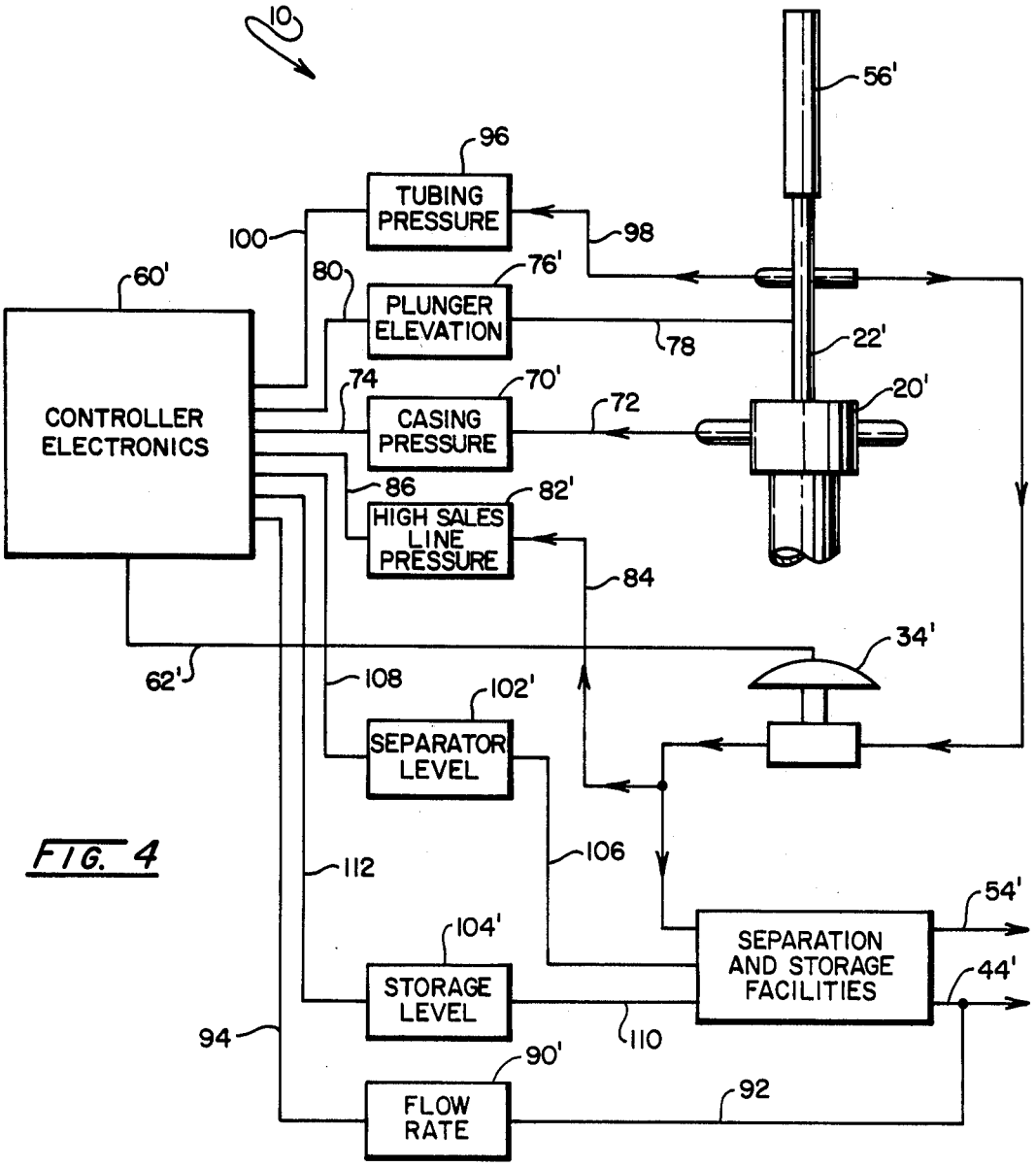
FIG. 4 is a block diagramatic schematic drawing showing the system of the invention.

Looking additionally to FIG. 4, parameter controls represented in FIG. 1 are shown in block diagrammatic fashion. Where the same functions or components as are described in FIG. 1 are again represented in FIG. 4, identical but primed numeration is utilized in the latter figure. FIG. 1 shows the presence of a switching gauge 70 connected to well head 20 in a manner wherein it monitors casing pressure. Should this pressure continue to fall to a dangerously low level following the opening of motor valve 34, an indication may be present that liquid is building up in the tubing and casing faster than it is being expulsed. Accordingly, the operator may wish to override a timed production cycle and shut-in the well upon this pressure reaching a certain level. As shown in FIG. 4, the communication between casing pressure monitor 70' and well head 20' is represented by line 72, while the electrical indication generated by function 70' is shown being introduced to controller electronics block 60' as along line 74. Pressure responsive switching gauges which may be utilized as above-described are available in the market, for example being produced by Frank W. Murphy Manufacturing, Inc., Tulsa, Okla. Generally, a normally open, single-pole—single-throw switch which closes at a programmed pressure level is incorporated within such gauges.

The figures further reveal the presence of a magnetically actuated proximity switch 76 positioned adjacent the upper extension of tubing string 22 and somewhat adjacent bumper 56. This switch is actuated when plunger 26 is in its uppermost orientation. Incorporating a normally open switch which is closed upon the plunger 26 reaching that upward orientation the switch affords the development of a production interval which is determined by the physical movement of plunger 26 as opposed to the utilization of a predetermined fixed interval. The magnetic association between plunger string 22' and the proximity switch 76' is represented in FIG. 4 by line 78, while the electrical signal to controller electronics 60' is represented by line 80.

Positioned upon conduit 38 on the sales line side of motor valve 34 is another switching gauge 82 which serves to monitor the line pressure aspects of the gas distribution system. Particularly where compressors and the like are incorporated in such distribution systems, high pressure fluctuations may be encountered. Where such line pressure exceeds predetermined limits it is important to override the operation of the well, inasmuch as plunger 26 may be prevented from performing a full cycle whereupon the well will rapidly commence to be loaded up to the point of failure. Accordingly, as represented in FIG. 4, gas pressure at the sales line is monitored by function 82' by connection therewith, as represented by line 84. Where such pressure exceeds predetermined value, an input is provided along line 86 to the electronics of controller 60'.

Another parameter of operation over which monitoring may be desired is that of the velocity of gas as it is initially presented to the sales line. FIG. 1 reveals the presence of a flow rate switching gauge 90 measuring the differential gas pressure across a restriction within line 44. For any given tubing geometry at given pressure there exists a critical gas velocity below which liquid will not be entrained. The switching flow meter type pick-off as at 90 can be utilized to monitor such as input and cause the well to be shut-in where such liquid velocities are not maintained. FIG. 4 reveals the instant function at 90' coupled to line 44' through line 92 and providing an input to the electronics of controller 60' through line 94. This input preferably is provided by closing a normally open switch. FIG. 4 additionally shows the conventional measurement of tubing pressure at block 96. The association of function 96 with the tubing string at an outlet T thereof is represented by line 98, while an electrical signal representative of low tubing pressure of the like may be provided along line 100 to the electronics of controller 60'.

In addition to the performance monitoring of the installation 10, monitors additionally may be provided looking to the safety aspects of well system performance. For example, a normally open high liquid level responsive switch may be provided both within separator function 40 as well as storage tank 50. FIG. 1 shows such switches respectively at 102 and 104. Liquid level responsive switches are available in the market, being produced, for example, by Dover Corporation, Norris Division, Houston, Tex. FIG. 4 shows the liquid level monitoring functions at 102' and 104', separator monitoring being represented by line 106 with switching input line to control electronic 60' being provided at 108 and storage level monitor 104' being associated with the separation and storage facilities through line 110 and providing a switching input to controller electronics 60' along line 112.

Upon the assertion of one of the various monitoring switching inputs to the electronics of controller 60', the motor valve 34 may be closed, for example, by the electrical actuation of a shuttle valve or the like and consequent development of or release of pressure within line 62'. With the use of the control electronics of the instant invention, the well operator is afforded a broad choice of controls over any given installation. For example, various parameters can be combined in typical gating procedures to apply any series or combination of inputs to develop a control over motor valve 34'. As a consequence, much improved opportunity for optimizing the production of wells is availed.

Figure 2:
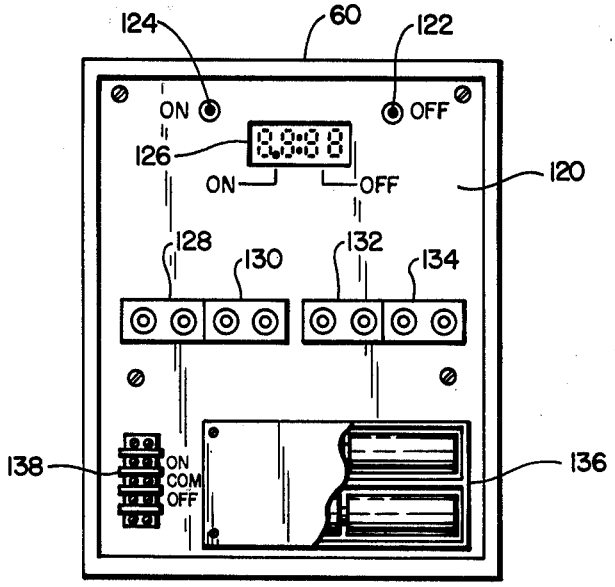
FIG. 2 is a front elevational view of the control panel of a controller according to the invention with portions broken away to reveal internal structure.

Looking to FIG. 2, the face plate contained within the weatherproof controller housing 60 is revealed at 120. This face plate carries a visual information output as well as components requiring replacement of manual setting in the course of well operation. For example, a switch 122 may be depressed to commence the timing of an "off" cycle wherein the well is shut in or pressure is off the diaphragm of motor valve 34. Correspondingly, the manual depression of switch 124 commences the timing for an "on" cycle wherein pressure is on the diaphragm of motor valve 34, or the well is produced. Immediately beneath switches 122 and 124 is a numerical readout component 126 which is shown, for illustrative purposes, to be reading 88 hours and 88 minutes. The presence of a period between the 88 hours digits represents that pressure is on the diaphragm of motor valve 34. Correspondingly, the presence of such a period between the 88 minutes digits represents that pressure is off the diaphragm of the motor valve. The colon intermediate the hour and minutes notation is selected to oscillate to show the presence of a power on condition. Additionally, a blinking of the hours digits is utilized as a low battery level indicator. Beneath the numerical readout 126 are banks of numerically adjusted rotary input switches representing cycle time wherein pressure is on the diaphragm of motor valve 34 respectively for hours and minutes at 128 and 130. Correspondingly, rotary switches for inserting desired cycle times wherein pressure is off the diaphragm for hour and minute designations are represented respectively at 132 and 134. A power supply for the entire assembly is provided within an appropriate battery container 136 which is readily accessible to the operator. With the utilization of CMOS type electronics within the controller, such batteries have a very long life span, for example in the range of about eight months. The wiring input from the above-noted external parameter functions is conveniently provided at the base plate 120 at normally open switch terminals 138.

Looking now to the control circuitry of the invention, a distinct advantage to the utilization of the control technique of the invention resides in its very low power consumption, coupled with a greatly broadened capability of control. This desirable operation is achieved preferably through the use of COS/MOS components which ideally consume power only during logic transitions. Further, the components generate almost no switching noise, providing perhaps the quietest of gating systems. Inasmuch as such components now are available in multi-function form, the commercial designations thereof are provided herein where appropriate. To facilitate the description to follow, when the inputs or outputs of a component are at ground or appropriately pass a corresponding reference potential, they are referred to as "low." Conversely, when these inputs or outputs assume or approach the voltage status of the power supply, they are referred to as being "high."

Figure 3A:
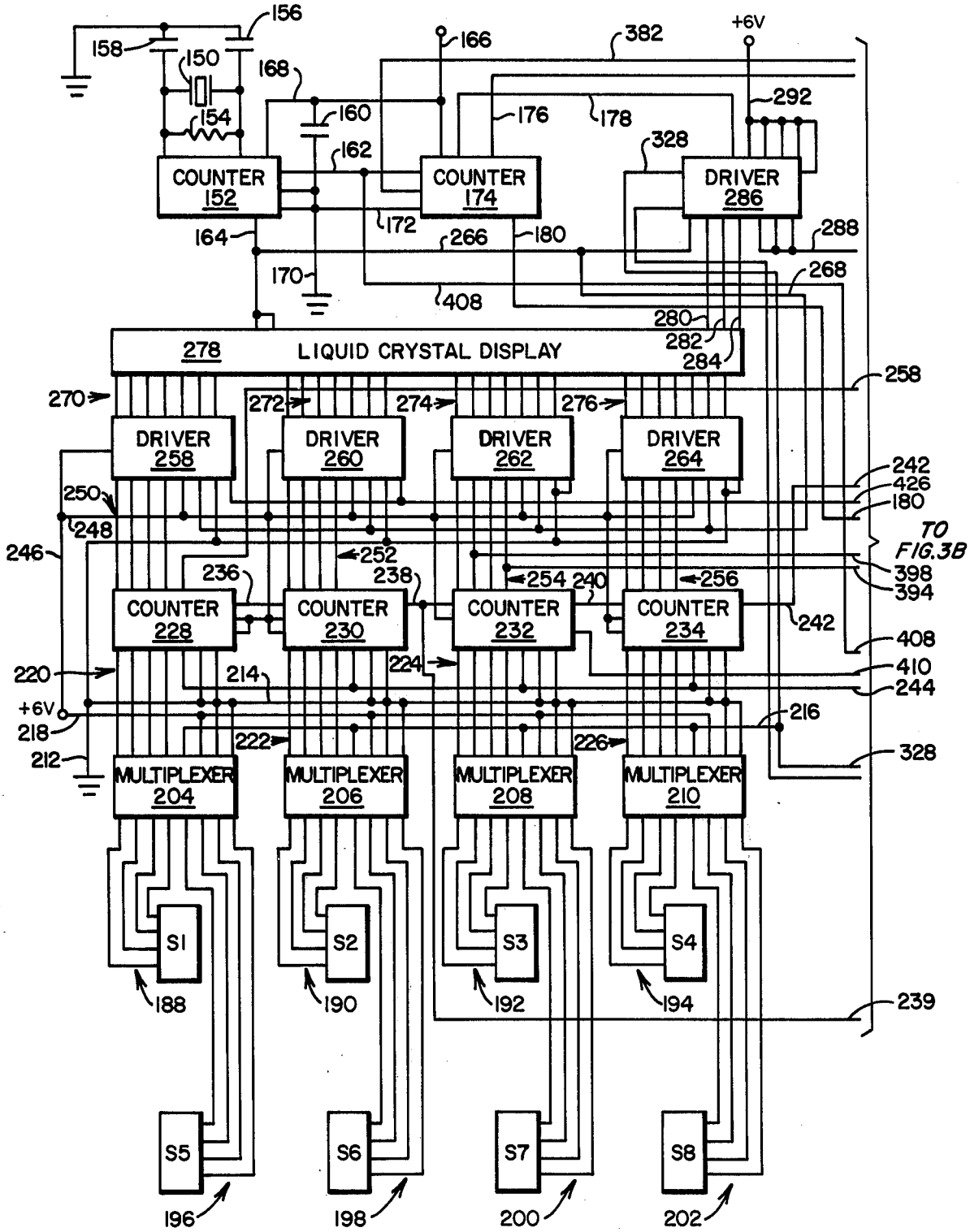
FIGS. 3A and 3B, when combined having FIG. 3B placed to the left of 3A, provide a schematic representation of the control circuit of the controller of the invention.

In its general operation, the control circuit of the invention incorporates ripple carry counters into which are inserted the on cycle and off cycle time data through operator manipulation of the switches as described at 128–134 in connection with FIG. 2. This data is inserted through drivers to a liquid crystal display to give the operator a visible indicia of the state of any given cycle. Upon pushing an on or off start switch, an electromagnetically actuated valve is properly positioned to control the motor valve 34 for a shut in or producing state and the counters are activated to commence to count down from the time values inserted through the above-noted switches. At the termination of a given cycle, a carryout signal serves to cause the cycle to automatically commence counting down the time interval selected for the next successive operational state, i.e. an off state following an on state. Various other aspects of the circuit and system will become apparent as discussion thereof unfolds. For the purpose of clarity, in the foregoing description of FIGS. 3A and 3B, FIG. 3B should be considered as juxtaposed to FIG. 3A in accordance with the bracket and labels appearing thereon. Basic pulse train input to the circuit is provided by a logic gate oscillator with crystal control. The principal components of this function are present as a 1.11848-MHz quartz crystal operating in conjunction with a fourteen stage ripple-carry counter 152. The latter component may be a model CD4060BE produced by RCA Corporation, Solid State Div., Somerville, N.J. When connected in conventional fashion as shown with bias resistor 154 and capacitors 156, 158 and 160, counter 152 serves as an accurate and stable time base, providing a 273.07 Hz pulse train output at line 162 as well as a 68.27 Hz pulse train at line 164. Counter 152 is of generally basic structure, typically implemented with j-k flip flops, the output of successive ones being connected to a next following flip flop input to provide count propagation in sequential order. Power to counter 152 is asserted from a six volt battery supply connected from lines 166 and 168, while ground coupling to the counter is derived from lines 170 and 172.

Counter 152 is coupled to a substantially identical ripple counter 174 through line 162. Counter 174 serves a frequency dividing function, providing the principal clock frequency of 0.016667 Hz or one cycle per minute at its output line 176. The counter also is tapped to provide a 1.07 Hz output pulse train at line 178 which will be seen to provide a colon blinking action representing a power "on" indication. Further, the counter is tapped at line 180 to derive a 0.26 Hz signal which ultimately is utilized in conjunction with a low battery warning feature. As in the earlier case, ground input to counter 174 is provided from lines 170 and 172, while power input from the battery supply derives from line 166.

Figure 3B:
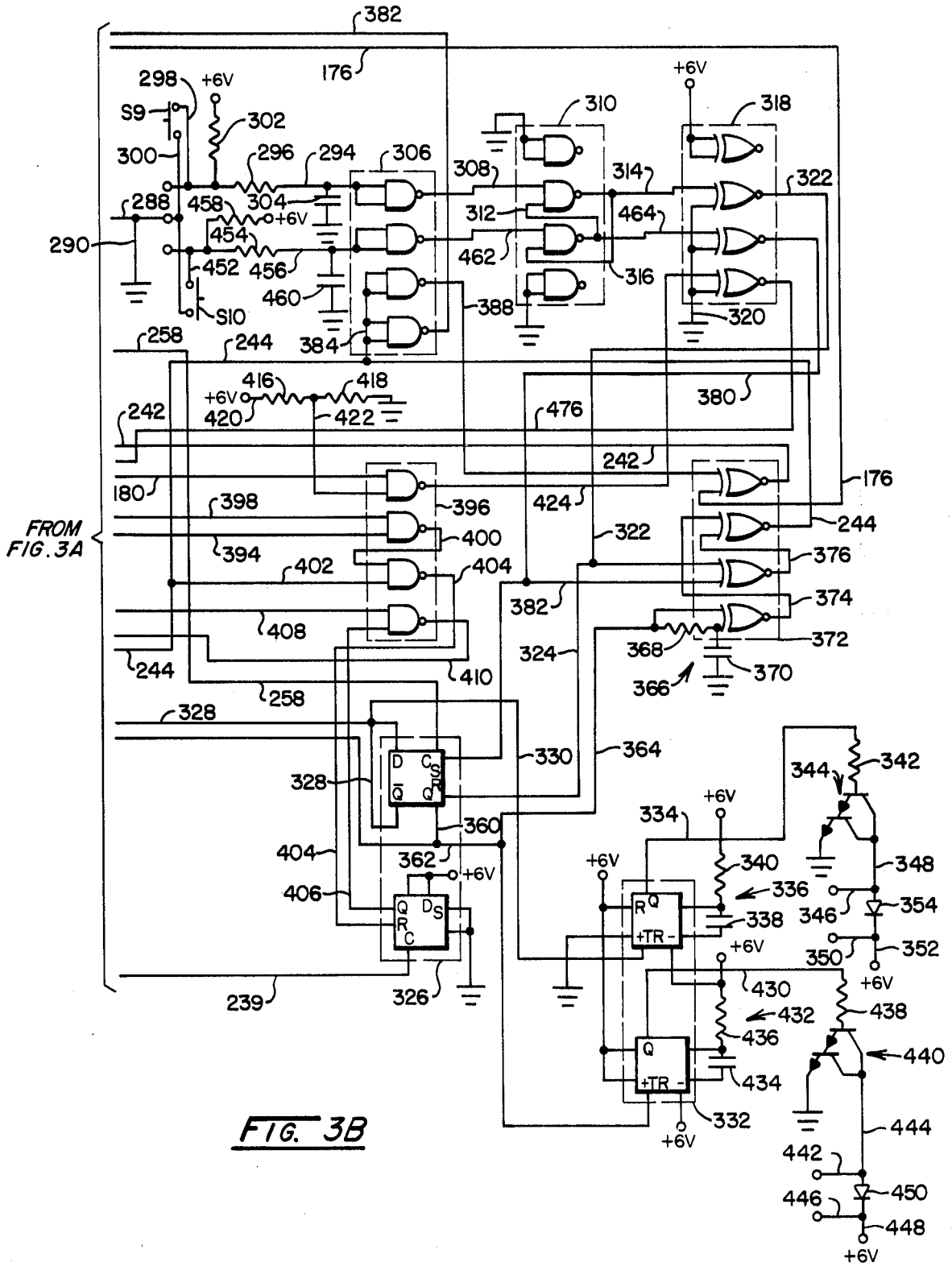
Figure 3C:
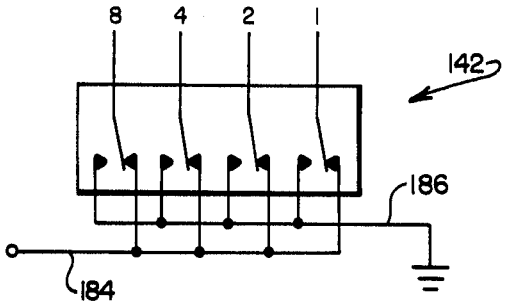
FIG. 3C provides a schematic representation of a switch arrangement utilized in conjunction with the circuit portion of FIG. 3B.

Looking momentarily to FIG. 3C, a schematic representation of the manually settable switches described at 128–134 in connection with FIG. 2 is illustrated generally at 142. As revealed in the drawing, the switch arrangement may be of a two-pole binary variety, one set of four poles, represented at 184, being coupled to the positive side of the battery supply, while the opposite set of poles 186 are commonly coupled to ground. By appropriate manipulation of a dial or the like, a binary coded decimal signal (BCD) may be developed for insertion into the count circuitry. Typical of such switches are those marketed under the trade designation "stripswitch," model No. 21XX56G by E.E.C.O. Corporation, Santa Ana, Calif.

Returning to FIG. 3A. such switches as at 182 are set forth in block schematic fashion at S1–S8. The switches are arranged such that switches S1–S4 provide time selection for a state wherein pressure is off the diaphragm of motor valve 34. Conversely, switches S5–S8 provide time data inputs for determining the cycle wherein pressure is on the diaphragm of motor valve 34. Looking to the off-condition switches, switch S1 is positioned to provide BCD signals representing tens of hours through the grouping of four leads represented at 188. Switch S2 provides BCD signals in hour units through the grouping of four leads 190. Switch S3 provides BCD signals representing tens of minutes through the grouping of four leads 192 and switch S4 provides BCD signals representing minute units through the grouping of four leads 194.

Looking to the corresponding "on" condition of the switches, switch S5 provides BCD signal inputs along the grouping of four lines 196 representative of tens of hours. Switch S6 provides BCD signals representing hour units along the grouping of four leads 198. Switch S7 provides BCD signals along the grouping of four leads 200 representing tens of minutes and switch S8 provides BCD signals representing minute units along the grouping of four leads 202.

Lead groupings 188 and 196 from respective switches S1 and S5 are directed to the input pins of a quad, two-input multiplexer 204. Such multiplexers are monolithic complementary MOS (CMOS) integrated circuits constructed with N and P channel enhancement transistors. Incorporating select and enable inputs, such multiplexers are marketed under the model designation MM74C157 by Pioneer-Standard Electronics, Inc., Dayton, Ohio. The four lead groupings 190 and 198 of respective switches S2 and S6 similarly are directed to the inputs of multiplexer 206. This multiplexer may be identical to that described at 204. Similarly, the lead groupings 192 and 200 of respective switches S3 and S7 are directed to corresponding inputs of the miltiplexer 208, while lead groupings 194 and 202 of respective switches S4 and S8 lead to the inputs of multiplexer 210. As before, multiplexers 208 and 210 may be identical to that described at 204. Ground reference inputs to multiplexers 204–210 emanate from lines 212 and 214, while connection between the battery supply positive output and each of the multiplexers is provided from trunk line 218. A binary select signal may be inserted simultaneously into each of the multiplexers from along line 216. In the latter regard, at such time as line 216 is high, the signal information presented by off-state switches S1–S4 is transmitted through respective multiplexers 204–210. Conversely, when line 216 is at a logical low, multiplexers 204–210 transmit the information developed from respective switches S5–S8.

The outputs of multiplexers 204, 206, 208 and 210 are presented at respective groupings of four leads 220, 222, 224 and 226, looking from the left extreme toward the right for each of the multiplexer symbols. These groupings of leads are coupled with the inputs of respective synchronous four-bit up/down decade counters 228, 230, 232 and 234. The latter are monolithic complementary MOS (CMOS) integrated BCD counters. Typical of the components which can be used for these counters are devices marketed as model No. MM74C192 by National Semi-Conductor Corporation, Santa Clara, Calif. The counters are cascaded by the mutual interconnection of the countdown inputs thereof with corresponding borrow outputs, for example; as along line 236, connecting counter 228 with counter 230; along line 238, connecting counter 230 with counter 232; and along line 240, connecting counter 232 with counter 234. The countdown input to counter 234 is supplied from along line 242. Ground reference input to each of the counters is derived from trunk line 214 leading to ground line 212, while a load command is asserted simultaneously to each from along line 244, loading occurring when that line receives a load pulse. Positive reference power is supplied to each of the counters, 228, 230, 232 and 234 from trunk lines 246 and 248. Upon operating upon the data inputs thereto from line groupings 220, 222, 224 and 226, the counters provide countdown outputs thereof at respective four line groupings 250, 252, 254 and 256 and, it may be noted, that the carry output of counter 228 is coupled to a line 259.

Output groupings 250, 252, 254 and 256 are connected to the corresponding inputs of drivers 258, 260, 262 and 264. These drivers may, for example, be present as BCD-to-seven segment decoder/drivers designed for use with liquid crystal readouts. Generally they are constructed with complementary MOS(CMOS) enhancement mode devices and are marketed as model No. Mc14543B from Motorola Semiconductor Products, Inc., Phoenix, Ariz. The high level side of the power supply is connected to the drivers from along trunk lines 246 and 248, while their ground reference coupling is provided from along line 212. Phase inputs to each of the drivers 258–264 is inserted from the output of counter 152 through lines 164, 266 and 268. The seven component outputs of drivers 258, 260, 262 and 264 are present at the seven line groupings represented respectively at 270, 272, 274 and 276. These outputs line groupings lead to the corresponding inputs of a seven segment liquid crystal display 278. Such displays are characterized in a very low current demand, thus permitting the use of a convenient inexpensive battery power supply for the instant controller. Of course, it should be understood that other forms of display incorporating light emitting diodes (LED's) of the like may be utilized, but with a loss of current conservation capabilities. Displays as at 278 are available, for example, as model No. 8655 marketed by Shelly Associates, a subsidiary of Datatron, Inc., Irvine, Calif. The back plane of display 278 is driven from line 164 by application of the 68.27 Hz pulse output thereon deriving from counter 152. Liquid crystal displays as at 278 provide a seven segment readout as typified at 126 in FIG. 2. In this regard, four numerical digits are separated by a colon and decimal points may be positioned at least intermediate the external pairs of digits of the display. As noted above, the decimal point inputs are utilized in the instant invention to show the operational cycle, i.e. the presence of pressure on or off the diaphragm of motor valve 34, while the colon is utilized to represent a power on indication. The inputs to drive these indicia are presented from lines 280, 282 and 284, which extend from another driver 286. In this regard, line 280 provides the signal for driving the "on" decimal point; line 282 provides the signal for driving the colon; while line 284 provides the signal for driving the "off" state decimal point. Driver 286 may be provided as a four segment display driver such as model No-CD4054AE marketed by RCA Corporation (supra). The ground reference input to driver 286 emanates from lines 288 and 290, the display frequency input thereto emanates from line 266 extending from line 164 and carrying the 68.27 Hz output of counter 152. Additionally, driver 286 receives the colon drive pulse frequency input at 1.07 Hz from along line 178. This input is passed into the above-described output lines by virtue of the connection of the strobe inputs of the driver with a constant high voltage level, i.e. to the battery source as through line 292.

Figure 5:
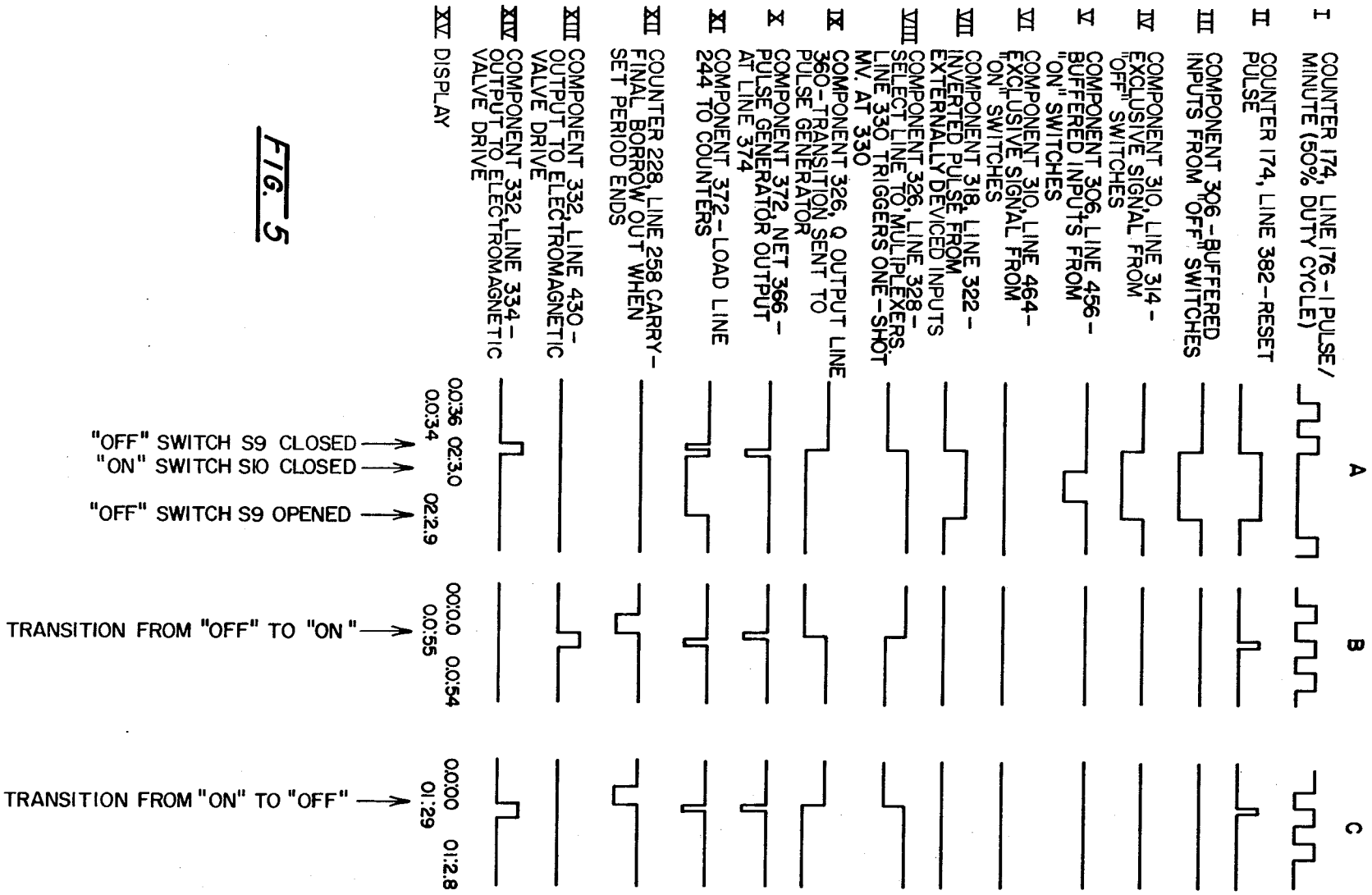
FIG. 5 shows a series of logic waveforms generated in conjunction with the operation of the circuit of FIGS. 3A–3B.

Now turning to the logic control over the above-described timing system, reference additionally is made to FIG. 5. The latter figure provides voltage timing diagrams for three logic conditions. Under vertical column A, certain voltage conditions are revealed when the timer is on an arbitrarily selected 0.0:34 minutes remaining in an "on" cycle and the operator presses the start "off" button as revealed at 122 in FIG. 2. Columns B and C of the figure provide timing information respectively for the automatic transition from an "off" to an "on" state and the opposite transition from "on" to "off." The latter two transitions occur with switch S1–S4 settings of 01:30 (off) and switch S5–S8 settings of 00:55 (on), these settings being arbitrarily assigned for exemplary purposes.

The start "off" switch button 122 shown in FIG. 2 is represented in FIG. 3B as switch S9, while corresponding "on" start switch 124 is represented at switch S10 in the circuit diagram.

With the closure of switch S9 or the equivalent thereof through inputs from external monitors, as described in connection with FIGS. 1 and 4, line 294, incorporating resistor 296, is coupled to ground through lines 298, 300, 288 and 290. Line 294 is coupled through a resistor 302 to the positive side of the battery power supply. As line 294 is coupled to ground, a capacitor 304 is discharged through resistor 296, thus altering the voltage level at line 294 from a high to a low (See level III of FIG. 5). Line 294 is coupled to the inputs of one NAND gate of a four gate component delineated by dashed boundary 306. Component 306 may, for example, be present as a COS/MOS quad of two-input NAND Schmitt triggers marketed as model CD 4093B by the Radio Corporation of America (supra). The Schmitt trigger feature of these devices permits a desirable snap-action response with a hysteresis or dead band. The transition at line 294 causes line 308, extending from the uppermost NAND gate output, to assume a high value which is directed to one input side of a NAND gate within four gate component 310. Component 310 is identical to four gate component 306. The opposite input to the subject NAND gate within component 310 is normally high by virtue of its line 312 connection. Consequently, the output of the gate at line 314 transitions to a low value. This signal is asserted through line 316 to a next lower NAND gate within component 310 which is coupled in similar fashion through a start switch S10. As represented at level IV of FIG. 5, the low value at line 314 represents the exclusive signal from switch S9, the "off" start switch. The signal at line 314 is connected to one input of an exclusive NOR gate within a composite assembly of four such gates at 318. Such composite assemblies as at 318 are marketed, for example, by Radio Corporation of America, (supra) as model No. CD4077B. The opposite input of the exclusive NOR gate being coupled to ground through line 320, the output thereof at line 322 transitions to a high. This logic level, illustrated to level VII in FIG. 5, represents the signal to override any ongoing "on" condition or state. The high value at line 322 is transmitted through line 324 to the reset input of one COS/MOS flip-flop of a composite, dual "D"-type flip-flop represented within dashed boundary 326. Components as at 326 are marketed by RCA Corporation (supra) under the model designation CD4013. As the reset input of the flip-flop is brought high, the $\overline{Q}$ output thereof at line 328 transitions to a high (See level VIII in FIG. 5). Line 328 is coupled with line 216 leading to the select input to each of the multiplexers 204, 206, 208 and 210 to cause them to select the switching state (off) determined at switch S9. This high signal at line 328 also is directed to one input of driver 286 to cause it to activate an appropriate "off" decimal point status indicator through line 284. As is additionally represented at level VIII in FIG. 5, the high level at line 328 is asserted through line 330 to the leading edge triggering input of the positive tripping input TR of one multi-vibrator within the composite component identified by a dashed boundary 332. Components as at 332 are marketed by RCA Corporation (supra) under the model designation CD4098BE. The leading edge triggering occasioned by the signal at line 330 causes the Q output thereof at line 334 to exhibit a high signal the pulse length of which is determined by an R.C. timing network 336 incorporating capacitor 338 and timing resistor 340 connected as shown to circuit timing inputs of the multi-vibrator (See FIG. 5, level XIV). Note that resistor 340 is coupled to the positive voltage of the power supply of the apparatus.

The signal at line 334 is asserted through resistor 342 to the base of the first NPN stage of a Darlington connected transistor pair 344. As a consequence, transistors 344 are turned on to, in turn, couple lines 346 and 348 to ground. Line 346 is coupled to one side of a tractive electromagnetic drive for a valve within controller housing 60, to be described in detail hereinafter. The opposite side of the input to the electromagnetically actuated valve is connected through lines 350 and 352 to the positive side of the battery power supply and lines 346 and 350 are mutually electrically isolated by a blocking diode 354. As a consequence of the energization of the electromagnetic components of this valve, the system is altered to a state wherein pressure is imposed upon the diaphragm of motor valve 34.

The Q output at line 360 of the upwardly disposed flip-flop within composite component 326 transitions to a low upon the assertion of the high input to the reset terminal thereof from line 324. Line 360 is connected through lines 362 and 364 to an R.C. timing network 366. Network 366 includes a timing resistor 368 coupled within line 364 and a capacitor 370, these components being commonly connected to one input to an exclusive NOR gate formed within a composite assemblage of four thereof as represented by dashed boundary 372. Composite component 372 may be identical to that described at 318. As connected to the associated exclusive NOR gate, network 366 serves to form therewith a pulse generator function having a pulse output at line 374, represented at level X in FIG. 5 and ultimately utilized for loading commands at line 244. Line 374 also extends to one input of an exclusive NOR gate within component 372 and the opposite input to that gate derives from line 376. The inputs to the exclusive NOR gate whose output is coupled to line 376 derive from lines 380 and 382, extending to an exclusive NOR gate within component 318 associated with switches S10. The opposite input thereto derives from line 324 which, by virtue of its coupling with line 322, is associated with the orientation of switch S9. Accordingly, the logic level at line 376 varies in accordance with the position of switch S9. Therefore, the signal at load line 244, for conditions wherein switch S9 is manually actuated by depression and then release, will exhibit an output as represented at level XI into FIG. 5. Upon manual release of switch S9, the logic level at line 244 transitions from a low to a high, however, the loading function will have been carried out. The former logic alteration, however, is utilized for the purpose of resetting counter 174 from line 382. In this regard, it may be observed that load line 244 is connected through line 384 to a NAND gate within component 306, the output of which is connected to line 382. The inverting function thus created permits a high to low transition to be asserted through line 382 to accurately set the timing function of the circuit.

Line 384 additionally is connected to a second gate within component 306 the output of which is present at line 388. Line 388 is joined with line 176 at the input to another exclusive NOR gate at a component 372 having an output at line 242 leading to the down count input to counter 234. As represented at level I in FIG. 5, this exclusive NOR gate treatment causes the count down input at line 244 to provide an initial positive-going clock transition to immediately remove one minute from the display at 278. This arrangement is necessary, inasmuch as the display would otherwise stay on 0.0:00 for one full minute as counter 174 divides a final minute of a cycle and thereby add one minute extra to the desired timed interval.

As thus far described, the informational input to display 278 is of a decade configuration. Consequently, it is appropriate to convert the readout to an hours and minutes representation. To carry this out, when a carry pulse is received from counter 232 at line 238, it is transmitted to the clock input of the lower flip-flop within composite component 326. This causes the Q output thereof at line 406 to go high, and the signal is asserted at the input to one two-input NAND Schmitt trigger of a composite COS/MOS quad two-input NAND Schmitt trigger identified by dashed boundary 396. This component may be identical to that described at 306. The opposite input to that NAND Schmitt trigger is from line 408 which extends to the output line 162 of counter 152. Accordingly, a 273 Hz pulse input is supplied from line 408 through the NAND trigger to line 410 which extends to the upcount of counter 232. The resultant pulse train rapidly runs the second digit of the display upward through the numbers 0–4. When the BCD equivalent of five is reached, a signal representing that number is present at lines 394 and 398 of counter 232. These lines form the input to another NAND Schmitt trigger within component 396 having an output at line 400 leading to one input of still another NAND Schmitt trigger therewithin. The opposite input to that trigger derives from line 402 which is coupled to load line 244. The resultant low signal at line 404 is introduced to the reset input of the lower flip-flop in component 326. In consequence, the Q output thereof at line 406 resets to a high level to, in turn, stop the high frequency upcount pulse train.

The circuit of the invention also provides an indication of low battery power supply levels. The read out indicating this condition is developed by periodically blinking the first two digits in the display at 278 which are driven by drivers 258 and 260. In this regard, it is a characteristic of the NAND gates of component 396 that as the voltage imposed thereupon at their inputs commences to drop below a normal or standard operating range for the gate, the trigger level value thereof becomes variable or non linear. This variance is to an extent wherein the triggering voltage for the NAND trigger alters to a high percentage of the now diminishing supply voltage input level and ultimately approaches and reaches that level. Accordingly, a divider network is provided incorporating divider resistors 416 and 418 within line 420. Line 420 is coupled between battery supply voltage and ground and the junction between resistors 416 and 418 is connected along line 422 to one input side of the NAND Schmitt trigger within component 396. This provides the "supply" to the trigger. The opposite input to the trigger emanates from line 180 which provides a 0.26 Hz pulse train. Since the input voltage level as defined by the divider network at line 422 remains a fixed percentage of supply voltage, the voltage asserted at input line 422 eventually drops to cause the trigger to react by triggering and transmitting the pulse train from line 180 to line 424. This signal is inverted at a gate within component 318 and submitted along line 426 to one input of drivers 258 and 260 to carry out the blinking warning function.

Looking additionally to column B of FIG. 3C, the automatic transition from an "off" state to an "on" state is considered. While the curves shown in column B of the figure apply to the automatic transition as may be encountered with operation from the settings of column A, columns B and C, respectively, are described as at level XV in connection with exemplary switch settings of 0:55 for an on cycle and 01:30 for an off cycle time.

No externally derived signal is needed to effect the continuing cycle "off" to "on" transition. For example, a carryout pulse is generated by the final counter 228 at line 259. Line 259, in turn, leads to the clock input of the upper flip-flop within component 326 (See level XII, FIG. 5). In consequence, the logic levels at lines 328 and 360 reverse and a positive going signal is asserted from lines 360 and 362 to the lower disposed one shot multivibrator transition terminal within component 332. This causes the Q output thereof at line 430 to exhibit a high signal, the pulse length of which is determined by an R.C. timing network 432. Network 432 includes a timing capacitor 434 and timing resistor 436 connected, as shown, to circuit timing inputs of the lower multi-vibrator. Note, that resistor 436 is coupled to the positive voltage of the power supply. The signal at line 430 is asserted through a resistor 438 to the base of the first NPN stage of a Darlington connected transistor pair 440. As a consequence, transistors 440 are turned on to, in turn, couple lines 442 and 444 to ground. Line 442 is coupled to one side of a tractive electromagnetic drive for a valve within controller housing 60, as is discussed in detail later herein. The opposite side of the input to that electromagnetically actuated valve is connected through lines 446 and 448 to the positive side of the battery power supply. Lines 442 and 446 are mutually electrically isolated by a blocking diode 450. As a consequence of the energization of the electromagnetic components of the noted valve, the system is altered to a state wherein pressure is released from the diaphragm of motor valve 34. Note also should be made that the signal transitions at lines 360 and 362 also are witnessed through line 364 at network 366. This is the pulse generator network which serves, as above described, to provide a load line input. In the latter regard, reference should be made to level IX of column B of FIG. 5.

As noted above, column C of FIG. 5 provides logic data representing a transition from an "on" to an "off" state where the off input switches have been adjusted to read: 01:30. As revealed at level XII, when a carry-out pulse is derived from counter 228 at line 259, a pulse is asserted at the clock input to the uppermost flip-flop of component 326. This causes level transitions at its $\overline{Q}$ and Q outputs which are carried by respective lines 328 and 360. The system then commences to carry-out a countdown as earlier described in connection with the depression of switch S9.

For a manual commencement of an "on" state of the control system, switch S10 is momentarily depressed. Such closure of the switch serves to connect lines 452 and 456, incorporating resistor 454, to ground through lines 300, 288 and 290. Line 456 is coupled through a resistor 458 to the positive side of the battery power supply. As line 456 is so coupled to ground, a capacitor 460 is discharged through resistor 454, thus altering the voltage level at line 456 from a high to a low value. Line 456 is coupled to the inputs of one NAND gate of component 306. The transition at line 456 causes line 462, extending from its associated NAND gate output, to assume a high value which is directed to one input side of a NAND gate within four gate component 310. If the opposite input to that gate at line 316 is high, a resultant low signal is fed through line 464. It should be noted, however, that when line 314, connected to line 316, is low, an off start cycle will have been commenced, for example, through switch S9. As shown at level V in FIG. 5, a momentary depression of switch S10 will have no effect on a normally progressing off start cycle. Assuming, however, that line 314 is high, a resultant low output is developed at line 464 which is converted to a high value at component 318 for presentation along line 380 through line 382 to the set input of the uppermost flip-flop within component 326. The earlier-described signal transition at the Q and $\overline{Q}$ outputs thereof, respectively, at lines 360 and 328 is carried out to cause the system to carry out a cycle. It may be noted that the transitions at the latter flip-flop are represented at levels VIII and IX in FIG. 5, and for the instant operation at column B thereof.

As discussed in detail above, the electronic logic of the controller serves to selectively energize the tractive electromagnetic actuators of a valve arrangement retained within the housing of controller 60. This valve receives relatively low pressure gas, i.e. 25 p.s.i.g., through lines 64 and regulator 66 as described in connection with FIG. 1.

Referring to FIG. 6, a schematic portrayal of the operation and components of such a valve are revealed. In the figure, a main valve body is shown at 500 which includes a cylindrical valve bore 502 associated in gas transfer relationship with five conduits. In the latter regard, gas output conduit 504 extends through a threaded connector 506 to be coupled with the diaphragm of motor valve 34. Venting conduit 508 will be seen to vent the diaphragm of the motor valve 34 to the atmosphere, while gas input conduits 510 and 512 serve to selectively vent bore 502. A gas input condiut 514 extends from a gas distribution conduit present as an elongate bore 516 which, in turn, is associated through a conduit 518 and threaded connector 520 to the noted input of gas under pressure. Bore 516 also communicates through two transversely disposed control outlets or conduits 522 and 524 with electromagentically actuated valves shown respectively in schematic fashion at 526 and 528. Valves 526 and 528, in addition to communicating and gas transfer relationship with respective conduits 510 and 512 also communicate in atmospheric venting relationship with venting conduits shown, respectively, at 530 and 532.

Slideably positioned in bore 502 is a shuttle piston 534 which, depending upon the vented status of either of conduits 510 or 512, assumes a terminal position serving either to direct pressurized gas from input 520 into conduit 504, or to vent the motor valve 34 diaphragm through conduit 508. Shuttle 534 is formed having three spaced, groove-carrying circular flanges 536, 538 and 540, the centrally disposed grooves of which respectively retain O-rings 542, 544 and 546. These flanges define, with bore 520, two adjacent gas flow regions.

The schematic representation of valves 526 and 528 reveals that each contains an inductive winding, shown respectively at 548 and 550, and an associated poppet, respectively revealed at 552 and 554. Poppets 552 and 554, respectively, are biased such that they tend to normally close off respective conduits 522 and 524. Upon energization of an associated winding, the appropriate poppet 552 or 554 serves to block off a vent at 530 or 532.

In the orientation shown in FIG. 6, neither winding 526 nor winding 528 is energized and gas under pressure may enter through fitting 520, conduit 518 and pressurized bore 516. The pressurized gas then flows through conduit 514 across shuttle 534, through conduit 504 and fitting 506 to prezzurize the diaphragm of motor valve 34. When winding 550 is energized or pulsed with current, for example, for about 100 milliseconds, poppet 554 seals conduit 532 and pressurized gas flows from bore 516 through conduits 524 and 512 to enter one end of bore 502 and drive shuttle 534 to a position abutting the outlet of conduit 510. In this orientation, a gas flow circuit is presented permitting fitting 506 and conduit 504 to be in gas flow relationship with conduit 508 which is vented to the atmosphere. Accordingly, pressure is removed from the diaphragm of motor valve 34. Subsequent energization of winding 548 of valve 526 causes conduit 530 to be closed and the pressurization bore 502 from a path including conduit 510 for another pulsing interval. Shuttle 534 moves accordingly to the position shown in FIG. 6. Typical of the types of tractive electromagnetic actuated valves which can be utilized at 526 and 528 is a valve marketed by Clippard Instrument Laboratory, Inc., Cincinnati, Ohio under the model designation EV-3MLP.

A more practical and preferred embodiment of the schematically portrayed valve at FIG. 6 is illustrated in connection with FIGS. 7–9. In referring to those figures, components having common designations between those figures in FIG. 6 are represented with identical numeration but in primed fashion. FIGS. 7–9 reveal the presence of a main valve body 500'to which are coupled electromagnetically actuated valves 526' and 528' having a structure similar to the above-referenced exemplary valve. As before, a principal bore 502' is formed within the body 500' and is secured by two end plugs 556 and 558. Plugs 556 and 558 are retained in gas sealing relationship with the surface of bore 502' by being formed with the appropriate grooves and O-rings represented respectively at 560 and 562. Additionally, the plugs are bored at about a 30° angle with respect to horizontal to provide the earlier-described conduits 510' and 512'. These conduits lead to the respective tractive electromagnetically actuated valves 526' and 528'. Looking to FIG. 9, a valve as at 526' is revealed in more detail. Note, that the valve includes an inner connecting body ring 562 which serves to retain a poppet 564 within a spring like disk 566. Disk 566 normally retains poppet 564 against conduit 522', i.e. normally closed. The opposite side of the disk 566 shows a component 568 which retains the venting conduit 530' in position for closure upon the energization of an electromagnetic winding 570'. Disk 566 contains an opening 572 for permitting the venting of gases through conduit 530' at such time as the valve winding is energized. Additionally, the valve is formed having at least one conduit as at 574 arranged for gas transfer communication with bore 510'. Further, the valve incorporates a threaded connection 576 which, as revealed in FIG. 7, provides for its coupling with elongate bore 516'.

FIG. 7 shows the valve in a venting orientation wherein gases under pressure applied at connection 520' and entering bore 515', are blocked at condiut 514'. Should the winding 570 of valve 526' be energized, however, disk 566 is retracted toward the winding and vent 530' is closed. This permits the passage of gas through the valve and its conduit 574 into bore 510' to cause the piston 534' to move to the right and alter cycle status.

Since certain changes may be made in the above system and apparatus without departing from the scope of the invention herein involved, it is intended that all matter contained in the above description or shown in accompanying drawings shall be interpreted as illustrative and not in a limiting sense.

What is claimed is:

1. In a flowing gas well installation of a variety having a casing, a tubing string therein having its lower end open adajcent the lower level of the casing, said tubing string being connectable to a sales line and having a motor valve positioned intermediate said tubing string and sales line actuable in response to an on or off designated pneumatic state between open and closed orientations to derive respective producing and shut-in conditions of performance for said installation the improved controlled for actuating said motor valve, comprising:

means providing a d.c. source of power;

pneumatic valve means connectable between a source of gas under pressure and said motor valve and including first and second electromagnetically actuated valve means energizable from said source of power to direct said gas under pressure to effect respective said motor valve actuating on and off pneumatic states;

oscillator means coupled with said power supply for deriving a pulse train of predetermined stable frequency;

frequency divider means including multi-stage solid-state ripple carry counters for deriving at least one pulse train of frequency $f_1$;

display means selectively energizable from a plurality of driver input signals thereto to provide multi-segment derived visible indicia representative of time in hours and subdivisions thereof;

manually programmable switch means coupled with said source of power for generating binary coded decimal signals representative of selected time intervals represented in hours and subdivisions thereof for each said designated pneumatic state;

multiplexer means for receiving said binary coded decimal signals and responsive to a selected state input select signal and for transferring corresponding binary coded decimal signals at the outputs thereof;

binary counter means coupled for receiving said corresponding binary coded decimal signals from said multiplexer means and responsive in the presence of an asserted load signal and count command signal to in-crementally alter said received binary coded decimal signals in diminishing arithmetic progressional fashion and provide the initial received and altered binary coded decimal signals at outputs thereof and deriving a carry-out signal at the termination of said diminishing arithmetic progression;

driver means connected for receiving said binary counter means initially received and altered binary coded decimal signals to derive said driver input signals asserted at said display means;

off-state switch means actuable to derive an off-start signal;

on-state switch means actuable to derive an on-start signal; and control circuit means responsive to a said off-start signal and a said carry-out signal occurring at the termination of an on designated pneumatic state and including timed switching means for effecting the energization of said second electromagnetically actuated valve means for a predetermined interval, for simultaneously generating said load signal and said count command signal at said frequency, $f_1$ and responsive to a said on-start signal and a said carry-out signal occurring at the termination of an off designated pneumatic state for effecting the energization by said timed switching means of said first electromagnetically actuated valve means for a predetermined interval for simultaneously generating said load signal and said count command signal at said frequency, $f_1$.

2. The improved controller of claim 1 in which said off-state switch means and said on-state switch means are configured having normally open contacts connectable with corresponding normally open switches actuable in response to the presence of predetermined externally sensed phenomena.

3. The improved controller of claim 1 in which:

said frequency divider means is configured for deriving a second pulse train at a frequency, $f_2$;

said control circuit means includes detect gate means exhibiting a nonlinear input value triggering characteristic for voltages applied thereto below a normal operating range of voltages of said power source, divider network means for asserting at said detect gate means a reference voltage representing a predetermined percentage of said power source voltage means for simultaneously asserting the voltage of said power source to said gate means at said frequency, $f_2$, said detect gate means having an output signal at said frequency, $f_2$, when the value of said asserted power source voltage is at or below the value of said reference voltage;

said driver means being coupled with said detect gate means and said display means for energizing visible indicia thereof at said frequency, $f_2$, in the presence of said output signal.

4. The improved controller of claim 1 in which said control circuit means includes means responsive to said actuation of said off-switch means, said on-switch means, or the presence of said carry out signal for effecting a synchronizing reset of said frequency divider means.

5. The improved controller of claim 1 in which:

said display means includes mutually displaced operational state indicia for visually indicating the selected said on or off designated pneumatic state;

said driver means includes means responsive to first and second input state signals for energizing said display means to indicate respective said on and off designated pneumatic state; and said control circuit means is responsive to said off-start signal and to a said carry-out signal at the termination of a said diminishing arithmetic progression extant during a said off designated pneumatic state to derive said first input state signal, and responsive to said on-start signal and to a said carry-out signal at the termination of a said diminishing arithmetic progression extant during a said on designated pneumatic state to derive said second input state signal.

6. The improved controller of claim 1 in which:

said display means includes a power-on indicia for visually indicating the utilization of current from said source of power when activated;

said frequency divider means is configured for deriving a third pulse train at a frequency, $f_3$, in the presence of said current utilization; and said driver means includes means responsive to said frequency, $f_3$, for energizing said display means to activate said power-on indicia at said frequency, $f_3$.

7. The improved controller of claim 1 in which:

said frequency divider means is configured for deriving a second pulse train at a frequency, $f_2$, and a third pulse train at a frequency, $f_3$;

said display means includes a power-on indicia for visually indicating the utilization of current from said source of power when activated;

said control circuit means includes detect gate means exhibiting a non-linear input value triggering characteristic for voltages applied thereto below normal operating range of voltages of said power source, divider network means for asserting at said detect gate means a reference voltage representing a predetermined percentage of said power source voltage, means for simultaneously asserting the voltage of said power source to said gate means at said frequency, $f_2$, said detect gate means having an output signal at said frequency, $f_2$, when the value of said asserted power source voltage is at or below the value of said reference voltage;

said driver means being coupled with said detect gate means and said display means for energizing visible indicia thereof at said frequency, $f_2$, in the presence of said output signal, and responsive to said frequency, $f_3$, for energizing said display means to activate said power-on indicia at said frequency, $f_3$;

said frequencies being related by the expression: $f_3 > f_2 > f_1$.

8. The improved controller of claim 1 in which said pneumatic valve means comprises:

a valve body incorporating a cylindrical valve bore;

a shuttle piston slideably moveable between first and second terminal positions within said valve bore and configured to define first and second gas flow regions along said valve bore;

first and second gas input conduits communicating with said valve bore at respective said first and second terminal positions;

a gas distribution conduit communicating in gas flow relationship with said source of gas and having first and second control outlets;

a gas output conduit connectable in gas flow communication with said motor valve and communicating in gas flow relationship with said first valve bore at said first gas region when said shuttle piston is in said first terminal position and communicating in gas flow relationship with said valve bore at said second gas flow region when said shuttle piston is in said second terminal position;

a venting conduit communicating in gas flow relationship between said valve bore at said second gas flow region and the atmosphere;

a third gas input conduit communicating in gas flow relationship between said gas distribution conduit and said valve bore at said first gas flow region;

said first electromagnetically actuated valve means being configured for normally blocking said first control outlet and simultaneously venting said first gas input conduit to the atmosphere, and energizable to effect gas flow communication between said first control outlet and said first gas input conduit to cause said shuttle piston to move to said second terminal position; and said second electromagnetically actuated valve means being configured for normally blocking said second control outlet and simultaneously venting said second gas input conduit to the atmosphere, and energizable to effect gas flow communication between said second control outlet and said second gas input conduit to cause said shuttle piston to move to said first terminal position.

9. The improved controller of claim 8 in which said control circuit means timed switching means includes an R-C timing network having a time constant at least equal to the time interval required for said shuttle piston to travel from one said terminal position to the other.

10. A control system for use in conjunction with flowing gas well installations of a variety having as components, a casing, a tubing string therein, the lower level thereof being adjacent the lower level of the casing, a plunger movable between said lower level and a bumper situate at a well head through which said tubing string extends and is connected with the upper level of said casing, said tubing string being connected in gas and liquid flow relationship through a motor valve and separator facility to a sales line, and a liquid storage facility connected to receive liquid from said separator facility, said motor valve being pneumatically actuable between open and closed orientations to derive respective producing and shut-in states of performance, select said components exhibiting a sensible physical phenomenum representing an operational condition for which actuation of said motor valve to said closed orientation is appropriate, said system comprising:

a controller, including:

means providing a d.c. source of power;

pneumatic valve means connected between a source of gas under pressure and said motor valve and including first and second electromagnetically actuated valve means energizable from said source of power to direct said gas under pressure to effect respective said motor valve open and closed orientations;

manually programmable switch means coupled with said source of power for generating binary coded decimal signals representative of selected time intervals represented in hours and subdivisions thereof for each said state;

solid state timing means responsive to said binary coded decimal signals and to a count command signal to commence the timing of a said selected time interval and deriving a carry-out signal at the termination of said interval;

solid state display means responsive to said timing means for providing multi-segment derived visible indicia representative of time in hours and subdivisions thereof;

a normally open off-state switch having contact means closeable upon actuation to derive an off-start signal;

a normally open on-state switch having contact means closeable upon actuation to derive an on-start signal;

first terminal means electrically coupled with said off-state switch contact means for providing an auxiliary normally open switching function actuable to derive said off-start signal;

control circuit means responsive to a said off-start signal and a carry-out signal occurring when said motor valve is in said open orientation and including timed switching means for effecting the energization of said second electromagnetically actuated valve means for a predetermined interval and for simultaneously generating said count command signal, and responsive to said on-start signal and a carry-out signal occurring when said motor valve is in said closed orientation for effecting the energization by said timed switching means of said first electromagnetically actuated valve means for a predetermined interval and for simultaneously generating said count command signal; and detector means coupled with a select said component and including normally open switch means electrically associated with said first terminal means off-state switch contact means and responsive to a sensed said physical phenomenum of said select component to close for deriving said off-start signal.

11. The control system of claim 10 in which said selected component in said plunger and said detector means comprises a proximity actuated switch positioned at said well head in the vicinity of said bumper and actuable to close in response to the presence of said plunger at said bumper.

12. The control system of claim 10 in which said selected component is said tubing string and said detector means comprises a gas pressure actuated, normally open switch positioned in the vicinity of said well head and actuable to close in response to the gas pressure within said tubing string reaching a predetermined level.

13. The control system of claim 10 in which said selected component is said casing and said detector means comprises a gas pressure actuated, normally open switch positioned in the vicinity of said well head and actuable to close in response to the gas pressure within said casing reaching a predetermined level.

14. The control system of claim 10 in which said selected component is said sales line and said detector means comprises a gas pressure actuated, normally open switch positioned to respond to gas pressure within said sales line at the output side of said motor valve and actuable to close in response to the gas pressure within said sales line reaching a predetermined level.

15. The control system of claim 10 in which said selected component is said separator facility and said detector means comprises a normally open liquid level switch and actuable to close in response to the level of liquid in said facility reaching a predetermined elevation.

16. The control system of claim 10 in which said selected component is said storage facility and said detector means comprises a normally open liquid level switch and actuable to close in response to the level of liquid in said facility reaching a predetermined elevation.

17. The control system of claim 10 in which said selected component in storage line and said detector means comprises a flow rate switching gauge having normally open switch contacts actuable to close in response to the velocity of gas within said sales line falling below a predetermined value.

* * * * *